US006037905A

United States Patent [19]

Koscica et al.

[11] Patent Number: 6,037,905

[45] Date of Patent: Mar. 14, 2000

[54] AZIMUTH STEERABLE ANTENNA

[75] Inventors: Thomas E. Koscica, Clark, N.J.; Bruce J. Liban, Philadelphia, Pa.

[73] Assignee: The United States of America as represented by the Secretary of the Army, Washington, D.C.

[21] Appl. No.: 09/130,427

[22] Filed: Aug. 6, 1998

[51] Int. Cl.[7] ..... H01Q 1/26

[52] U.S. Cl. ..... 343/701; 343/815; 343/867

[58] Field of Search ..... 343/701, 702, 343/825, 826, 827, 833, 837, 799, 812, 813, 815, 817, 818, 819, 742, 741, 866, 867

[56] References Cited

U.S. PATENT DOCUMENTS 4,290,071 9/1981 Fenwick ..... 343/819

5,235,343 8/1993 Audren et al. ..... 343/817

5,243,358 9/1993 Sanford et al. ..... 343/819

5,489,914 2/1996 Breed ..... 343/818

*Primary Examiner*—Hoanganh Le

*Assistant Examiner*—Tan Ho

*Attorney, Agent, or Firm*—Michael Zelenka; George B. Tereschuk

[57] ABSTRACT

An antenna system is described having a plurality of elements, one of which is an active element for transmitting or receiving signal, the remaining elements acting as reflectors, and wherein the elements may be comprised of a series of diodes connected in series with conductors having a length that is a fraction of the wavelength of the design frequency. When its diodes are biased for conduction, an element can radiate or receive r.f. signals or act as a reflector, and when its diodes are not conducting, the element is transparent to r.f. of the design frequency.

5 Claims, 5 Drawing Sheets

AZIMUTH STEERABLE ANTENNA

GOVERNMENT INTEREST

The invention described herein may be manufactured used and licensed by and for the United States Government.

FIELD OF INVENTION

Communication Antennas.

BACKGROUND OF THE INVENTION

Steerable antennas are useful in civilian and military mobile communications as well as in the cellular phone industry. Direction of radio waves has been effected by dish antennas that are physically revolved and by phased arrays, both of which involve structures of considerable weight and significant expense.

SUMMARY OF THE INVENTION

In accordance with this invention, an antenna system is comprised of a plurality of parallel linear elements. In one embodiment, a centrally located element serves as a reflector and the direction of the antenna pattern is determined by which one of the surrounding elements is energized with an r.f. signal.

In a second embodiment of the invention, the r.f. signal is applied to a central element, and the direction of the pattern is determined by making one of the surrounding elements act as a reflector and making the other surrounding elements incapable of reflecting r.f., i.e. become transparent. For an element to act or not act as a reflector it is comprised of a series of diodes separated by conductors of a length that is a small fraction of the wavelength of the r.f. involved. When the diodes are not D.C. biased for conduction i.e., reverse biased, the element does not reflect because it is comprised of a plurality of separate conductors that are too short to reflect, but when the diodes are D.C. biased for conduction, the conductors are connected in series so as to be capable of reflection.

In accordance with a third embodiment of the invention, a plurality of elements are provided that are comprised of diodes connected by conductors of a length that is short in comparison with the wavelength of the r.f. involved. As described above, when the diodes are biased for conduction, an element can serve as a reflector, but it can also be an active element i.e. it can serve as a radiator when r.f. is applied to it or as a receiver for coupling r.f. to a transceiver. And, if the diodes are not conducting due to D.C. reverse bias, an element is transparent. The direction of the pattern is determined by making one element act as a radiator and selected ones of the other elements, possibly only one, act as reflectors. The elements performing neither function are made to be transparent.

It is to be understood that the reception pattern of an antenna system of this invention is the same as its radiation pattern, as a result of the physical principle of reciprocity. Instead of applying r.f. to an element, it is connected to a receiver.

DETAILED DESCRIPTION OF THE INVENTION

Figure 1B:
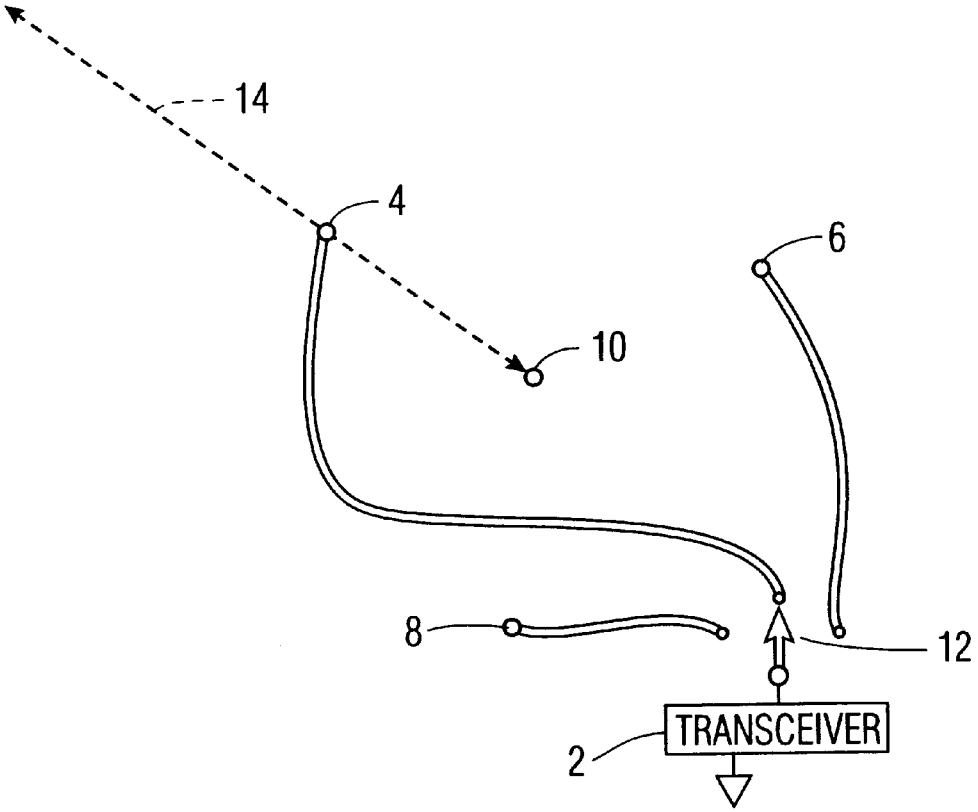
FIG. 1B is a view looking down in the antenna system of FIG. 1A illustrating the antenna patterns attained with certain interconnections of a transceiver with the elements of FIG. 1A.
Figure 1A:
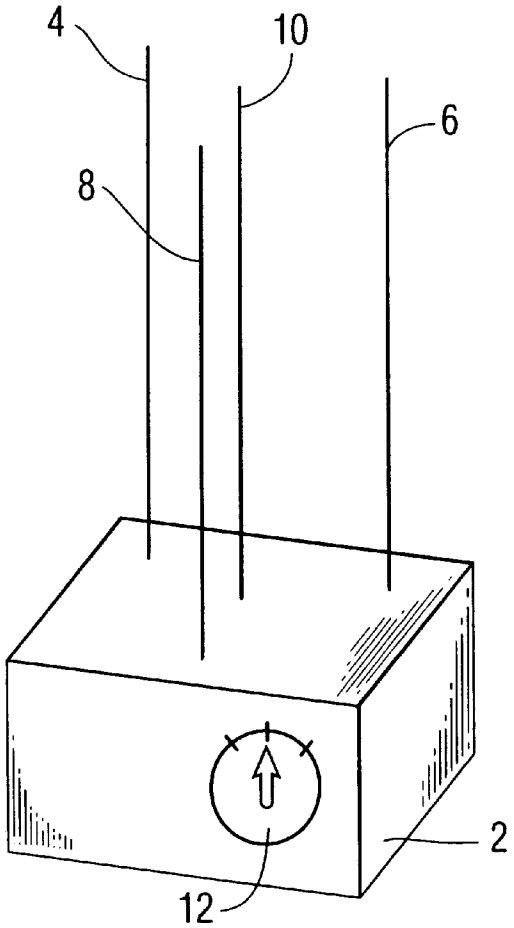
FIG. 1A illustrates an antenna system having a plurality of conductive elements mounted on a transceiver.

In FIG. 1A a transceiver 2 is shown having linear elements 4, 6, and 8 surrounding a central element 10 that are preferably at a distance therefrom of one-quarter wavelength of an r.f. signal that is to be transmitted or received. FIG. 1B schematically illustrates possible connections of the transceiver 2 to the surrounding elements 4, 6, and 8 that are made by a switch 12. In this embodiment of the invention, the central element 10 is a reflector, and the transceiver 2 is connected by the switch 12 to one of the surrounding elements 4, 6, and 8 so as to produce an antenna pattern centered on a line through that element and the reflector 10. For example, if, as shown, the switch 12 is connected to the surrounding element 4, the center of the pattern will be along a line 14. The surrounding elements not connected to the transceiver 2, in this case the elements 6 and 8, also serve as reflecting elements so as to affect the antenna pattern.

Figure 2C:
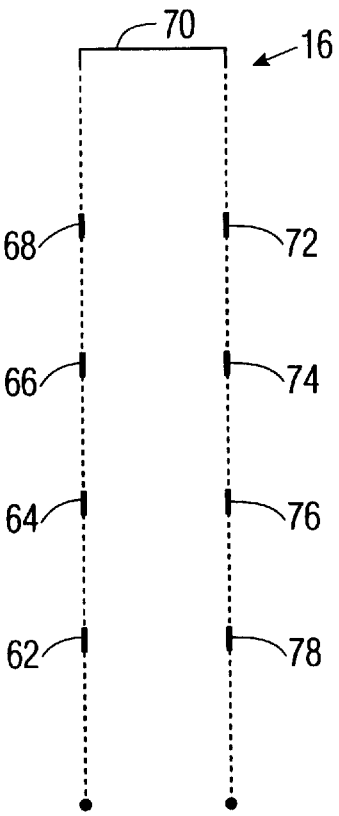
FIG. 2C is an alternating current (AC) schematic representation of the element of FIG. 2A when its diodes are biased for non-conduction so that the element is transparent.
Figure 2B:
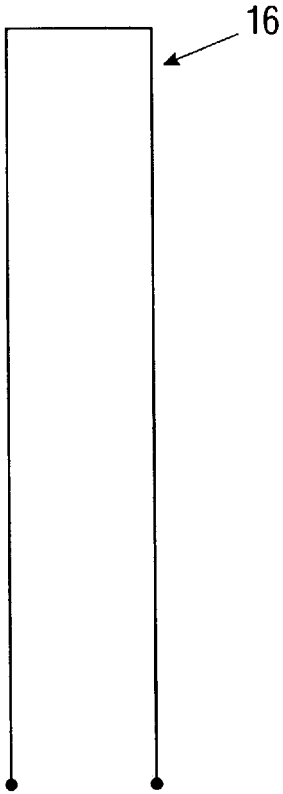
FIG. 2B is an alternating current (AC) schematic representation of the element of FIG. 2A when its diodes are biased for conduction so that the element can function as a reflector.
Figure 2A:
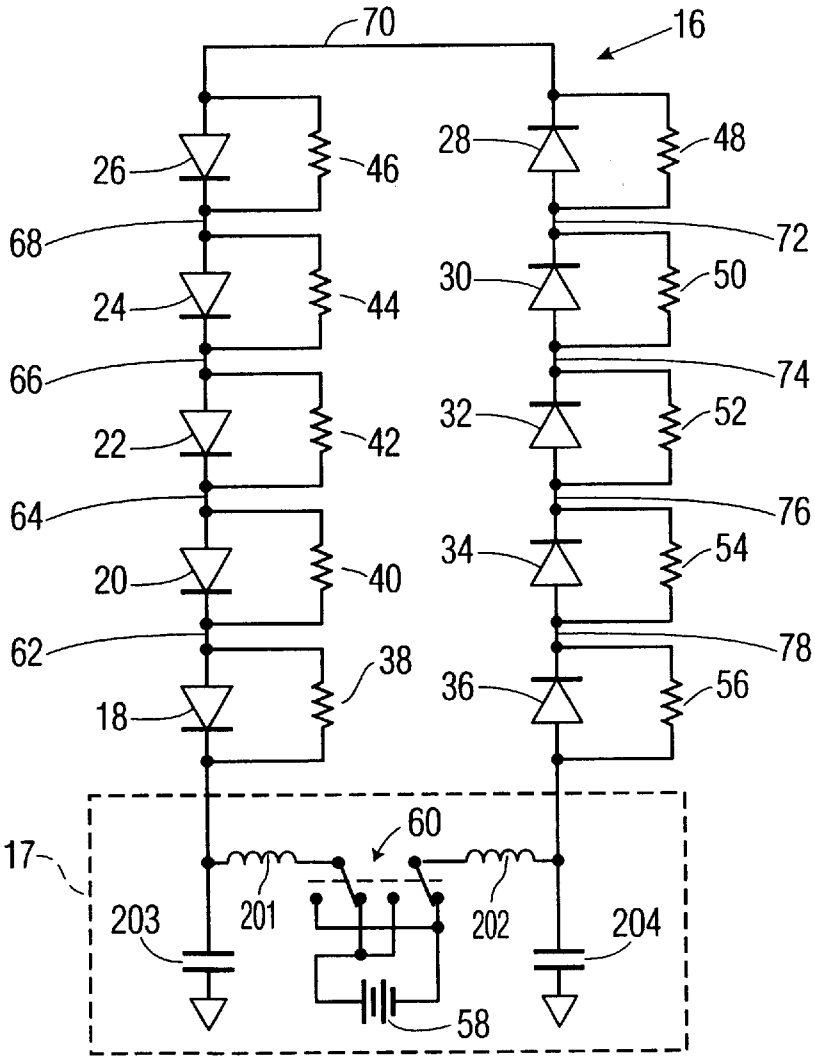
FIG. 2A shows an element including a series of diodes and a control circuit for biasing the diodes for conduction or non-conduction.

Reference is now made to FIGS. 2A, 2B, and 2C for a description of an antenna element 16 for use with the transceiver 2 that may, in accordance with a significant aspect of this invention, act as a reflector or be transparent so as to have no effect on r.f. Also shown is FIG. 2A is a control circuit 17 for making the antenna element 16 act as a reflector or be transparent. The element 16 is comprised of a series of PIN diodes designated by even numbers 18 through 36. Resistors designated by even numbers 38 through 56 serve to bias the diodes. The control circuit 17 includes a power supply such as a battery 58 that is coupled via a polarity reversing double pole double throw switch 60, between the ends of the element 16 so as to bias the diodes 18 through 36 for conduction or non-conduction as required. Inductors 201 and 202 prevent r.f. in the main antenna element 16 from leaking into the D.C. battery 58. Capacitors 203 and 204 prevent the D.C. supply 58 from being shorted to ground.

Between each of the diodes are conductors designated by even numbers 62 through 78 of a length that is a small fraction of the length of an r.f. wave that is transmitted or received by the transceiver 2. In this drawing, the conductor 70 is longer than the other conductors 62 through 68 and 70 through 78, but in actuality it could have the same length as the other conductors. There is, however, no requirement that the conductors 62 through 78 have the same length; it is only necessary that they be of a length that is a small fraction of the length of the r.f. wave involved.

When the double-pole-double-throw switch 60 is in the right-hand position, as shown, the diodes 18 through 36 are biased for conduction so that the element 16 is a continuous conductor for A.C. as shown in FIG. 2B that will act as a reflector. Reflection from such an element will significantly alter the beam pattern. On the other hand, when the switch 60 is in its left-hand position the diodes 18 through 36 are biased so as not to conduct so that the element 16 will appear as shown in FIG. 2C in which the conductors 62 through 78 are electrically disconnected for A.C. signals. The resistors 38 through 56 have such high values of resistance as to reduce any r.f. current to a negligible value. And, as each is only a small fraction of a wavelength of the r.f. involved, they appear transparent so as to have no effect on the antenna pattern. It will be noted that the diodes 18 through 26 are on one side of the element 16 and that the diodes 28 through 36 are on the opposite side so as to form a D.C. loop. This is necessary because if the diodes on either side were replaced by a single conductor so as to complete the circuit for the D.C. power supply 58, the conductor would act as a reflector. Altering the setting of the switch 60 thereby provides a means for altering the A.C. reflectivity of an element and in turn the resulting beam pattern.

Figure 3B:
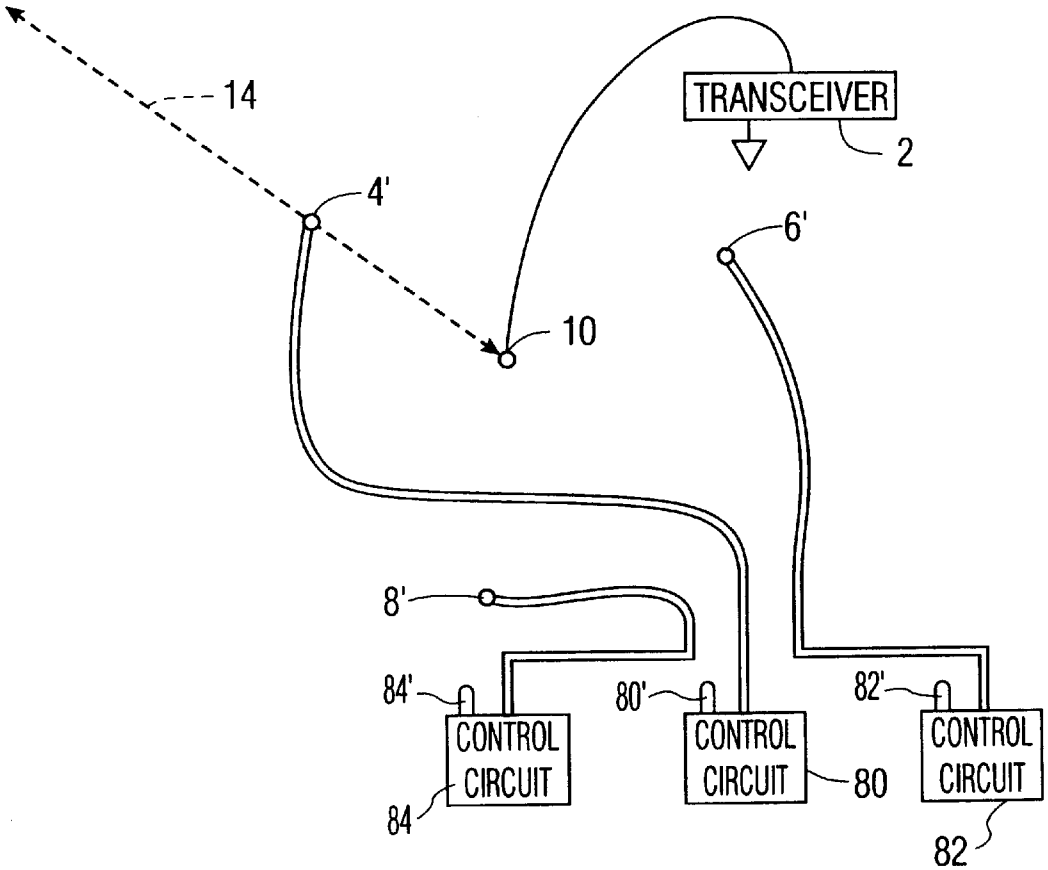
FIG. 3B is a view looking down on the antenna system of FIG. 3A and illustrating one antenna pattern that can be attained.
Figure 3A:
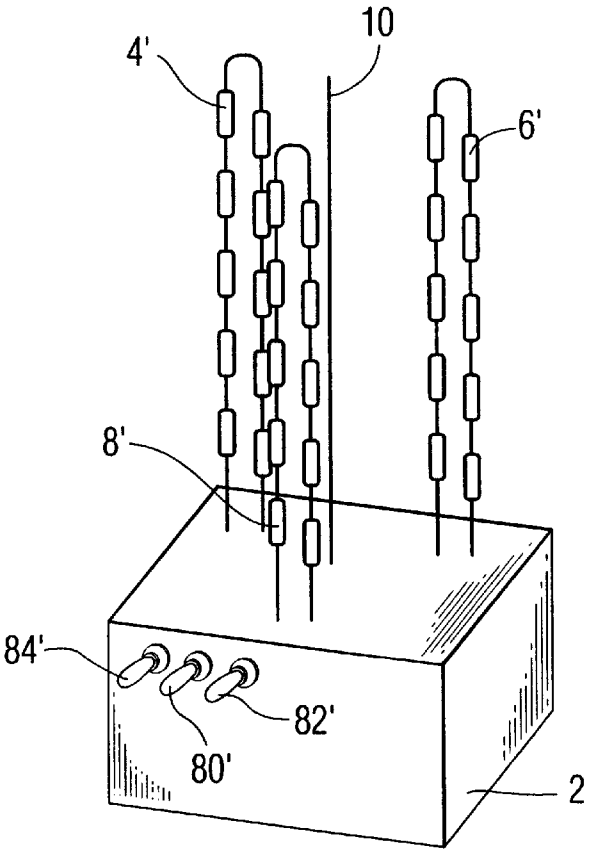
FIG. 3A illustrates a transceiver with an antenna system having some elements with a control circuit such as shown in FIG. 2A.

The antenna shown in FIG. 3A includes the central element 10 shown in FIG. 1A, but the surrounding elements 4', 6', and 8' are like the element 16 of FIG. 2A in which the diodes 18 through 36 and their biasing resistors are respectively represented by small unnumbered rectangles. As shown in FIG. 3B, the transceiver 2 is connected to the central element 10. As also shown in FIG. 3B, the elements 4', 6' and 8' are respectively connected to control circuits 80, 82, and 84, each of which is identified to the control circuit 17 of FIG. 2A. As shown in FIG. 2A each of the control circuits 80, 82, and 84 has a double pole, double throw switch 60. These switches 60 are designated as 80', 82', and 84' in FIGS. 3A and 3B. If the switches 80', 82', and 84' are positioned so that the diodes of all elements 4', 6', and 8' are non-conductive, the elements 4', 6', and 8' are transparent so that the antenna is omnidirectional. By operating the switches 80', 82', and 84' so as to make the diodes of one or two of the elements 4', 6', and 8' conductive so as to be reflective, the antenna pattern can be altered from omnidirectional to directional. By way of example, if the switches 80', 82', and 84' are set so that the diodes of the element 4' are conductive and the diodes of the elements 6' and 8' are not conductive, the antenna pattern will be centered on the dashed line 14 and extend in a direction from the element 10 toward the element 4'.

Figure 4:
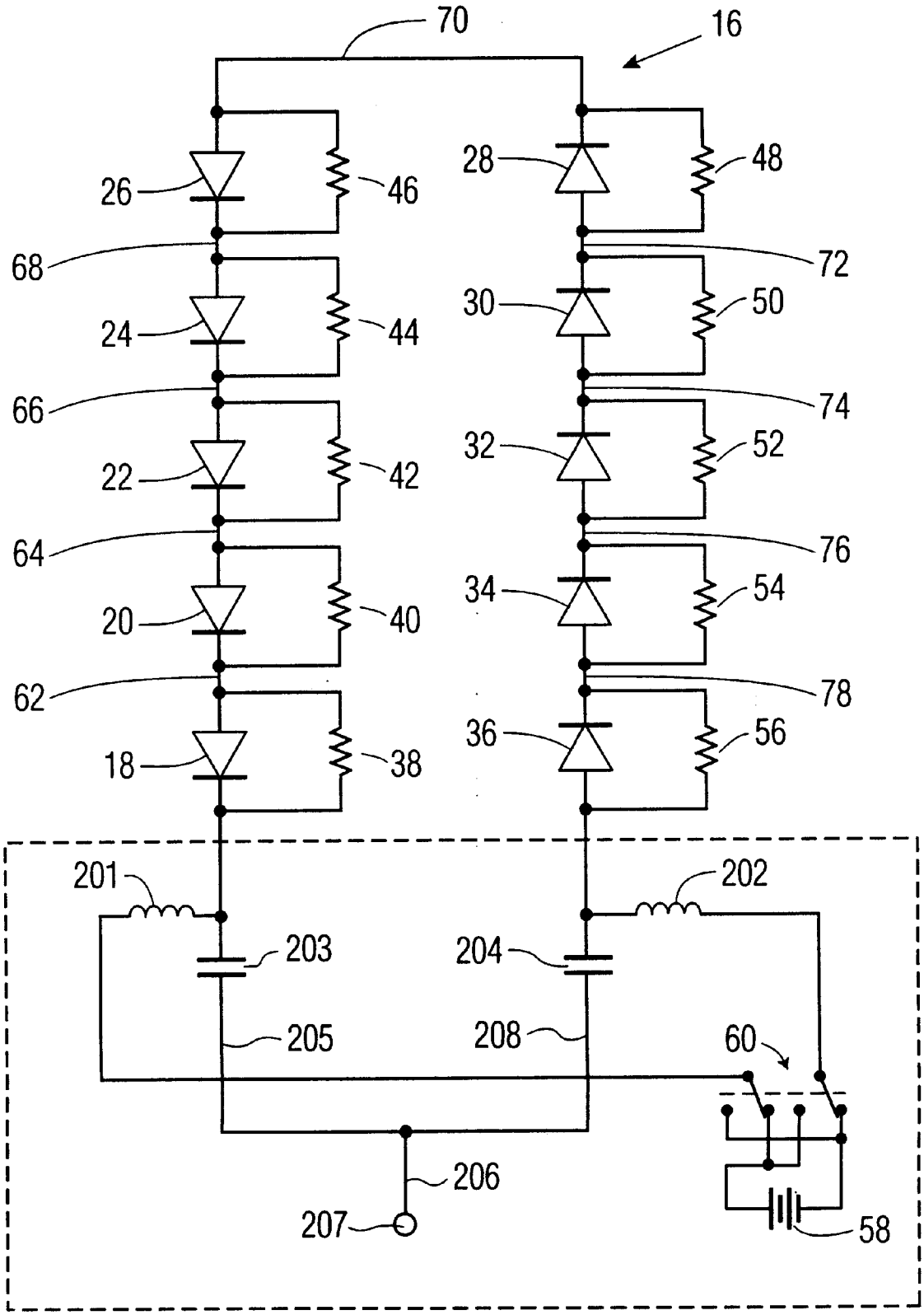
FIG. 4 shows an element including a series of diodes, a control circuit for biasing the diodes for conduction and means for applying r.f. to the element.

Reference is now made to FIG. 4 for a description of an antenna element 16 and a control circuit therefore that can make the element 16 appear to be transparent, to act as a reflector or to act as a radiator. Components in FIG. 4 that correspond to those of FIG. 2A are designated by the same numbers. A control circuit 17' of FIG. 4 differs from the control circuit 17 of FIG. 2A in that instead of connecting the capacitors 203 and 204 to ground, as in FIG. 2A, the capacitor 203 is connected via leads 205 and 206 to an input terminal 207 and the capacitor 204 is connected via a lead 208 and the lead 206 to the input terminal 207.

As in FIG. 2A the double-pole-double-throw switch 60 can be positioned so as to make the diodes 18 through 36 non-conductive, in which case the element 16 is transparent. Alternatively, the switch 60 can be positioned so as to make the diodes 18 through 36 conductive, in which case the element 16 can act as a reflector. When the diodes 18 through 36 are conducting, the element 16 will radiate r.f. applied to the input terminal 207.

Figure 5B:
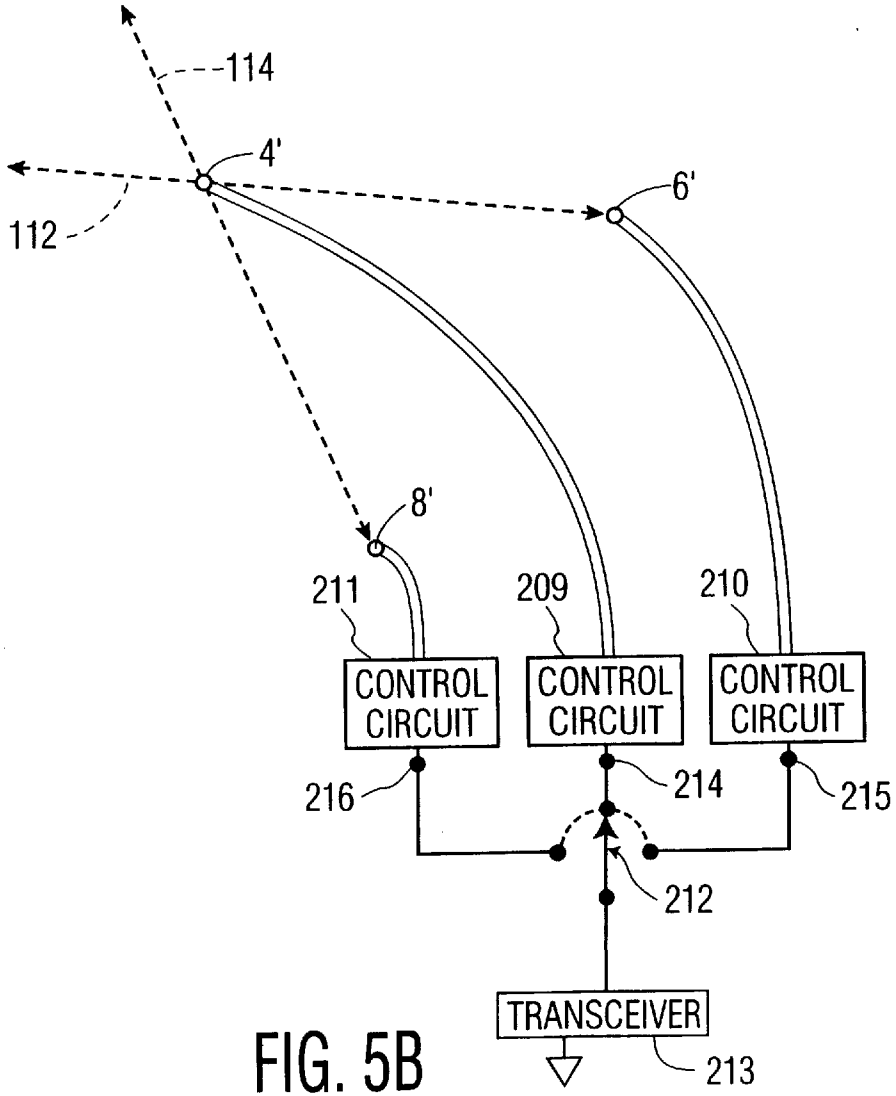
FIG. 5B is a view looking down on the antenna system of FIG. 5A that illustrates some antenna patterns that may be attained.
Figure 5A:
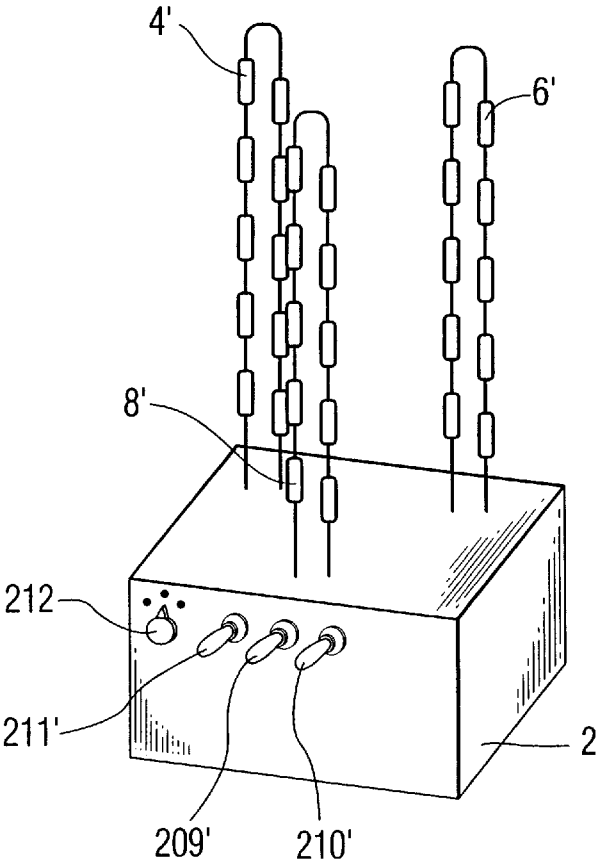
FIG. 5A illustrates a transceiver having an antenna system having a plurality of elements like the element shown in FIG. 4.

FIG. 5A illustrates one-way of utilizing the principles described in connection with FIG. 4. It has the same elements 4', 6', and 8' as in FIG. 3A, but the central element 10 is omitted. As shown in FIG. 3B, which is a view looking down on the elements 4', 6', and 8', the elements 4', 6', and 8' are respectively coupled to control circuits 209, 210, and 211 that are identical to the control circuit 17' of FIG. 4. As is evident from FIG. 4 each of the control circuits 209, 210, and 211 has a terminal 207, and the terminals 207 for control circuits are respectively designated 214, 215, and 216.

Operation of the antenna shown in FIG. 5B may be understood from the following examples. If the switch 211' is set so that the element 8' is transparent, and the switches 209' and 210' are set so that the diodes of the elements 4' and 6' are conductive, the antenna pattern will be centered on the dashed line 112. Now, if the switch 212 is in contact with the terminal 214 of the control circuit 209, as shown, the antenna pattern will be in a direction from the element 6' to the element 4', but if the switch 212 is in contact with the terminal 215 of the control circuit 210 the antenna pattern will be in a direction the element 4' to the element 6'.

Similarly, if the switches 211', 209', and 210' are set so that the diodes of the element 6' are non-conductive and the diodes of the elements 4' and 8' are conductive, the antenna pattern will be centered along the dashed line 114. With the switch 212 in the position shown, the antenna pattern will be in a direction from the element 8' to the element 4'.

It will be apparent to those skilled in the art that there are many configurations of antenna elements involving the switching of reflector and active elements including elements having diodes that may be formed. Also, other modifications may occur to those of skill in the art. Such modifications are meant to be covered by the spirit and scope of the appended claims.

What is claimed is:

1. An antenna system for a transceiver, comprising:

a central linear element;

a plurality of linear elements;

a means for coupling said transceiver to one of said plurality of linear elements, said plurality of linear elements surrounding said central element and being in parallel with said central element;

said plurality of linear elements being formed with diodes connected in series by conductors, the conductors having a length that is a fraction of a wavelength of an operating frequency of said transceiver connected to said antenna system; and a means for selectively biasing the diodes of any one of said plurality of linear elements into one of first and second modes, said first mode being for forward biasing said diodes to cause their associated linear element to act as a reflector, and said second mode being for revere biasing said diodes to cause their associated linear element to be transparent.

2. An antenna system for a transceiver comprising:

a plurality of antenna elements;

said antenna elements being comprised of a series of diodes connected by conductors that are a fraction of the wavelength of an operating frequency of said transceiver; and means for biasing the diodes of at least two of said antenna elements for conduction;

whereby the elements having diodes conducting can serve as a reflector or an active element.

3. An antenna element comprising:

a plurality of diodes arranged in a loop;

biasing resistors respectively in shunt with the diodes; and connectors between the diodes that are a small fraction of the wavelength for which the element is to be used.

4. An antenna system for a transceiver comprising:

a plurality of antenna elements each of which is formed by diodes connected in series by conductors to form a loop, the conductors being a fraction of the wavelength of an operating frequency of said transceiver, and biasing resistors respectively in shunt with the dividers;

a first bus;

a second bus; and switches for selectively coupling each of said antenna elements to either or both of said first and second buses.

5. An antenna system as set forth in claim 4 further comprising:

a source of D.C. voltage connected to said first bus; and said transceiver being connected to said second bus.

* * * * *